US012799629B2

(12) United States Patent
Yao et al.

(10) Patent No.: US 12,799,629 B2
(45) Date of Patent: Nov. 17, 2026

(54) ORIGINAL ECOLOGICAL BAMBOO FIBERS, PREPARATION METHOD AND APPLICATION THEREOF

(71) Applicant: JIYANG COLLEGE OF ZHEJIANG A&F UNIVERSITY, Zhuji (CN)

(72) Inventors: Wenbin Yao, Zhuji (CN); Wei Zhang, Zhuji (CN); Weipeng Yu, Zhuji (CN); Huawei Wu, Zhuji (CN); Chao Zhou, Zhuji (CN)

(73) Assignee: JIYANG COLLEGE OF ZHEJIANG A & F UNIVERSITY, Zhuji (CN)

( * ) Notice: Subject to any disclaimer, the term of this patent is extended or adjusted under 35 U.S.C. 154(b) by 280 days.

(21) Appl. No.: 18/653,297

(22) Filed: May 2, 2024

(65) Prior Publication Data

US 2025/0290229 A1 Sep. 18, 2025

(30) Foreign Application Priority Data

Mar. 18, 2024 (CN) ..... 202410306472.3

(51) Int. Cl.

| | |
|---|---|
| ***D06C 7/00*** | (2006.01) |
| ***D01B 1/50*** | (2006.01) |
| ***D01C 1/02*** | (2006.01) |
| ***D06C 19/00*** | (2006.01) |
| ***D21C 1/10*** | (2006.01) |
| ***D21C 3/02*** | (2006.01) |
| ***D21H 11/12*** | (2006.01) |

(52) U.S. Cl.

CPC ..... *D01B 1/50* (2013.01); *D01C 1/02* (2013.01); *D06C 7/00* (2013.01); *D06C 19/00* (2013.01); *D21C 1/10* (2013.01); *D21C 3/02* (2013.01); *D21H 11/12* (2013.01); *D10B 2201/10* (2013.01)

(58) Field of Classification Search

CPC ... D01B 1/50; D01C 1/02; D06C 7/00; D06C 19/00; D21C 1/10; D21C 3/02; D21H 11/12

See application file for complete search history.

(56) References Cited

FOREIGN PATENT DOCUMENTS

| | | | | |
|---|---|---|---|---|
| CN | 102206873 A | * | 10/2011 | |
| CN | 108277673 B | * | 10/2020 | ..... D21C 5/005 |
| CN | 110541319 B | * | 3/2021 | ..... D21D 1/20 |
| CN | 115559145 B | * | 2/2026 | ..... D21H 11/02 |

OTHER PUBLICATIONS

English Machine Translation CN108277673B, 2020 (Year: 2020).*
English Machine Translation CN110541319B, 2021 (Year: 2021).*
English Machine Translation CN115559145B, 2026 (Year: 2026).*
English Machine Translation CN102206873A, 2011. (Year: 2011).*

* cited by examiner

*Primary Examiner* — Anthony Calandra
(74) *Attorney, Agent, or Firm* — JEEN IP LAW, LLC

(57) ABSTRACT

Original ecological bamboo fibers and a preparation method and application thereof are provided in the present disclosure, belonging to the technical field of bamboo fibers, where the preparation method includes the following steps: cutting a bamboo material into sheets, feeding, slicing to obtain thin-layer bamboo slices, followed by cake pressing and cooking treatment, then cleaning and post-processing the bamboo slices to obtain the original ecological bamboo fibers. The present disclosure also discloses the original ecological bamboo fibers prepared by the preparation method and the application thereof in preparing bamboo fiber yarns.

6 Claims, No Drawings

ORIGINAL ECOLOGICAL BAMBOO FIBERS, PREPARATION METHOD AND APPLICATION THEREOF

CROSS-REFERENCE TO RELATED APPLICATIONS

This application claims priority to Chinese Patent Application No. 202410306472.3, filed on Mar. 18, 2024, the contents of which are hereby incorporated by reference.

TECHNICAL FIELD

The present disclosure belongs to the technical field of bamboo fibers, and in particular to original ecological bamboo fibers, a preparation method and application thereof.

BACKGROUND

At present, the original ecological bamboo fibers have been applied in the preparation of core materials for automobile interiors and mattress pads, providing a way for the high value utilisation of bamboo materials. To obtain the natural bamboo fiber, the bamboo material is usually softened and rolled and combed by the fiber-opening machine; although this method has been industrially applied, the fibers produced by this method are usually of different lengths and thicknesses, with problems of low fiber strengths, susceptible to brittle breakage, rough morphology, powdery materials with high ash content, and the production process is chemically contaminated, making the products available only for the production of composite materials.

Therefore, there is a pressing technical problem to be solved by the technicians in the field as to provide a bamboo fiber preparation method to ensure the quality of the bamboo fiber products.

SUMMARY

In order to solve the above technical problems, the present disclosure provides original ecological bamboo fibers and a preparation method and application thereof.

To achieve the above objectives, the present disclosure provides the following technical schemes.

A preparation method of the original ecological bamboo fibers, including following steps: cutting a bamboo material into sheets, feeding (bamboo sheets are generally long strips, size: width 2-3 (centimeters, cm) * thickness 3-6 (millimeters, mm) * length (50-80 (cm) or 1-3 bamboo joints), slicing for multiple times to obtain thin-layer bamboo slices, followed by cake pressing and cooking treatment, then cleaning and post-processing the bamboo slices to obtain the original ecological bamboo fibers.

Optionally, species of the bamboo material includes one or more of *Bambusa emeiensis, Bambusa intermedia, Bambusa chungii, Bambusa textilis, Pseudosasa amabilis, Dendrocalamus latiflorus* and *Dendrocalamus sinicus.*

Optionally, the slicing is to slice bamboo sheets into thin-layer bamboo slices with wrinkles in sequence by using a bamboo sheets planer machine, and a thickness of the thin-layer bamboo sheets is 0.05-0.25 mm;

a pass of the slicing is 20-60 passes; and a slicing angle of a blade of the bamboo sheets planer machine is 15-80 degrees) (°) to a slicing surface of the bamboo slices, and the slicing angle is capable of making a resulting thin layer of bamboo slices wrinkled.

Beneficial effects: as for slicing by this method, it is essential to ensure that the slicing direction is along the direction of bamboo fibers and not mis-laminated, so as to avoid that the bamboo sheets are not in the same fiber plane due to being cut off or mis-laminated. Moreover, it is necessary to set the curved blades (auxiliary or secondary blades) and make the angle of incision of the main planer blade 15-80°. The obtained bamboo slices are uniform in thickness and are wrinkled, and the tensile strength is extremely high.

Optionally, the cooking treatment specifically includes the following steps:

carrying out a primary cooking on the thin-layer bamboo slices after cake pressing with a softening solution under alkaline conditions, cleaning after the primary cooking, then carrying out a secondary cooking using a mixture of sodium chlorite and sodium nitrate under acidic conditions, cleaning again after the secondary cooking, and then carrying out a tertiary cooking under alkaline conditions using a mixture of hydrogen peroxide and osmotic agent.

Beneficial effects: by using this process, nutrients such as sugar and protein and most of hemicellulose and lignin are removed from the bamboo slices, and the fiber separation of bamboo slices is facilitated so that the bamboo slices are separated into forms of fiber bundles by the coupled effects of heat-force-chemistry.

Optionally, a temperature of the primary cooking is 90-150 degrees Celsius (°C), and a duration is 60-240 minutes (min);

the softening solution is a mixed aqueous solution of sodium hydroxide, penetrant and sodium silicate;

a mass concentration of the sodium hydroxide is 5-12%; and a mass concentration of the sodium silicate is 0.5-2%.

More optionally, a mass ratio of the thin bamboo slices to the softening solution after cake pressing is 1:(5-15).

The softening solution in the present disclosure is discharged to a recycling device after the primary cooking for further use in a next time, and the softening solution is capable of being recycled for 5-15 times.

Beneficial effects: the cooking process enables the removal of nutrients such as sugars and proteins in the bamboo slices under the action of alkaline solution, and at the same time removes hemicellulose and part of the lignin in the bamboo slices to create conditions for the subsequent process.

Optionally, a temperature of the secondary cooking is 45-65 °C., and a duration is 35-120 min;

a pH value of the mixed solution of sodium chlorite and sodium nitrate is 3-5, with a concentration of 20-50 grams per liter (g/L) of sodium chlorite and 5-20 g/L of sodium nitrate; and a material-liquid ratio in a process of the secondary cooking is 1:(3.5-15).

The process has the advantages that the insoluble lignin in the bamboo slices is partially removed in the previous process, and the separation of bamboo slice fibers is further promoted.

Optionally, a temperature of the tertiary cooking is 65-90 °C, and a duration is 30-60 min;

a pH value of the mixed solution of hydrogen peroxide and penetrant is 9-11, where a concentration of hydrogen peroxide is 15-150 g/L and a concentration of penetrant is 2-10 g/L;

the mixed solution of hydrogen peroxide and penetrant also includes sodium hydroxide, and a concentration of the sodium hydroxide is 3-15 g/L; and a material-liquid ratio in a process of the tertiary cooking is 1:(5-15).

The process has the beneficial effects that the insoluble lignin and other components in the bamboo slices from the previous process are partially removed again, which further promotes the separation of bamboo slice fibers and whitens the fiber bundles.

More optionally, the penetrant is one or more of JFC, scouring penetrant and bleaching penetrant.

Optionally, the post-processing includes primary dehydration, oiling, secondary dehydration, drying, and opening and carding.

Optionally, the oiling is to put the bamboo slices after the primary dehydration into emulsified white oil solution, followed by soaking at 60-90 °C for 60-360 min.

More optionally, the emulsified white oil solution includes solutes of emulsified white oil, penetrant and water.

The emulsified white oil includes following raw materials in mass fraction: 15-30% of saturated fatty acid (preferably hard fatty acid), 15-35% of amino alcohol, 15-45% of amino silicone oil, 5-10% of surfactant and 5-10% of stabilizer.

More optionally, the surfactant includes anionic surfactants such as sodium dodecyl sulphate and sodium dodecyl polyoxyethylene ether sulfate;

More optionally, the surfactant is sodium dodecyl sulphate or sodium dodecyl polyoxyethylene ether sulfate, or sodium dodecyl sulphate, sodium dodecyl polyoxyethylene ether sulfate, fatty acid and glycerol ester mixed in a mass ratio of 3:3:2:2; and the stabilizer includes gelatin, protein acid, hydroxypropyl methylcellulose and the like.

More optionally, the stabilizer is gelatin or hydroxypropyl methylcellulose, or gelatin, protein acid and hydroxypropyl methylcellulose mixed in a mass ratio of 3:3:4.

More optionally, the emulsified white oil includes following raw materials in mass fraction: 35% of saturated fatty acid (hard fatty acid), 25% of amino alcohol, 20% of amino silicone oil, 10% of surfactant (sodium dodecyl sulphate) and 10% of stabilizer (gelatin);

more optionally, the emulsified white oil includes following raw materials in mass fraction: 35% of saturated fatty acid (hard fatty acid), 25% of amino alcohol, 20% of amino silicone oil, 10% of surfactant (sodium dodecyl polyoxyethylene ether sulfate) and 10% of stabilizer (glyceride).

Optionally, in the emulsified white oil solution, a concentration of the emulsified white oil is 20-50 g/L, and a concentration of the penetrant is 2-10 g/L.

Optionally, a preparation method of the emulsified white oil solution includes following steps:

blending the raw materials of the emulsified white oil at room temperature in accordance with the above ratio to obtain the emulsified white oil, then mixing and formulating the emulsified white oil, penetrant, water and a fusion agent (detergent, sodium carbonate solution or soapy water, and the person skilled in the art may determine the amount of the fusion agent to be added according to the actual needs of the situation), and then stirring a resultant mixture for 10-15 min after the preparation, until a stable emulsion is formed, then obtaining the emulsified white oil solution.

After the above treatment, the bamboo fiber bundles are soft, smooth and elastic, which is convenient for later carding and fiber processing.

Original ecological bamboo fibers prepared by the method for preparing original ecological bamboo fibers.

An application of the original ecological bamboo fibers in bamboo fiber yarn.

A method for preparing bamboo fiber yarn, including following steps: using a slivering machine to make the original ecological bamboo fibers described above into strips, and then carrying out multiple drawing and carding, and then using a roving machine to spin support yarn, and then using a spinning machine to make the required number of counts, thereby obtaining the bamboo fiber yarn.

Optionally, a number of times of drawing and carding is 7 times.

Beneficial effect: after this process, the bamboo fibers are of consistent length and straight, and the fiber bundles are uniform, which lays the foundation for yarn formation.

Compared with the prior art, the present disclosure has the following advantages and technical effects.

The present disclosure provides the original ecological bamboo fibers and preparation method and application thereof, whereby fresh bamboo sheets are directly used to process bamboo fibers and cordage, and the production process involves only mechanical processing, and more importantly, the fibers produced are of high strength and good toughness, and the fibers are soft and slender, which are suitable for making high end cordage and for the production of spunnable bamboo fibers. The production method of this disclosure is green and efficient, with low production cost, high resource utilization and less material waste, and the bamboo fiber prepared by this disclosure resembles the form of hemp fiber, which is slender and uniform, and has the characteristics of high strength, good toughness and good spinnability.

DETAILED DESCRIPTION OF THE EMBODIMENTS

The technical schemes in the embodiments of the present disclosure are described clearly and completely in the following, and it is obvious that the described embodiments are only a part of the embodiments of the present disclosure and not all of the embodiments of the present disclosure. Based on the embodiments in the present disclosure, all other embodiments obtained by a person of ordinary skill in the art without making creative labour fall within the scope of protection of the present disclosure.

In order to make the above objectives, features and advantages of the present disclosure more obvious and easy to understand, the present invention will be further described in detail with reference to specific embodiments.

The embodiments of the present disclosure provides a preparation method of original ecological bamboo fibers, which includes the following steps:

cutting a bamboo material into sheets, feeding (bamboo chips are generally long strips, size: width 2-3 (centimeters, cm) * thickness 3-6 (millimeters, mm) * length (50-80 (cm) or 1-3 bamboo joints), slicing for multiple times to obtain thin-layer bamboo slices, followed by cake pressing and cooking treatment, then cleaning and post-processing the bamboo slices to obtain the original ecological bamboo fibers.

In a preferred embodiment, species of the bamboo material includes one or more of *Bambusa emeiensis, Bambusa intermedia, Bambusa chungii, Bambusa textilis, Pseudosasa amabilis, Dendrocalamus latiflorus* and *Dendrocalamus sinicus.*

In the preferred embodiment, the cutting is to saw bamboo stalks into bamboo tubes in accordance with a length of bamboo joints, and then using a blade of a mechanical impact crashing table to slice the bamboo tubes into bamboo slices with a width of 1.5-5 cm.

In a preferred embodiment, the slicing is to slice bamboo sheets into thin-layer bamboo slices with wrinkles in sequence by using a bamboo sheets planer machine;

a pass of the slicing is 20-60 passes;

a slicing angle of a blade of the bamboo sheets planer machine is 35-75° to a slicing surface of the bamboo slices, and the slicing angle is capable of making a resulting thin layer of bamboo slices wrinkled; and a thickness of the thin-layer bamboo sheets is 0.05-0.15 mm.

In a more preferred embodiment, a single bamboo slice planer machine is equipped with 1-15 blades, and 2-8 devices may be connected in series to form a production line. The planer adopts disposable blades, which may be changed automatically.

In a preferred embodiment, the cooking treatment specifically includes the following steps:

carrying out a primary cooking on the thin-layer bamboo slices after cake pressing with a softening solution under alkaline conditions, cleaning after the primary cooking, then carrying out a secondary cooking using a mixture of sodium chlorite and sodium nitrate under acidic conditions, cleaning again after the secondary cooking, and then carrying out a tertiary cooking under alkaline conditions using a mixture of hydrogen peroxide and osmotic agent.

In a preferred embodiment, a temperature of the primary cooking is 90-150 degrees Celsius (°C), and a duration is 60-240 minutes (min);

the softening solution includes sodium hydroxide and sodium silicate;

a mass concentration of the sodium hydroxide is 5-12%; and a mass concentration of the sodium silicate is 0.5-2%.

In a more preferred embodiment, a mass ratio of the thin bamboo slices to the softening solution after cake pressing is 1:(5-15).

In a preferred embodiment, a temperature of the secondary cooking is 45-65 °C, and a duration is 35-120 min;

a pH value of the mixed solution of sodium chlorite and sodium nitrate is 3-5, with a concentration of 20-50 g/L of sodium chlorite and 5-20 g/L of sodium nitrate; and a material-liquid ratio in a process of the secondary cooking is 1:(3.5-15).

In a preferred embodiment, a temperature of the tertiary cooking is 65-90 °C and a duration is 30-60 min;

a pH value of the mixed solution of hydrogen peroxide and penetrant is 9-11, with a concentration of hydrogen peroxide of 15-150 g/L and a concentration of penetrant of 2-10 g/L;

the mixed solution of hydrogen peroxide and penetrant also includes sodium hydroxide, and a concentration of the sodium hydroxide is 2-15 g/L; and a material-liquid ratio in a process of the tertiary cooking is 1:(5-15).

In a more preferred embodiment, the penetrant is one or more of JFC, scouring penetrant and bleaching penetrant.

In a preferred embodiment, the post-processing includes primary dehydration, oiling, secondary dehydration, drying, and opening and carding.

In a preferred embodiment, the oiling is to put the bamboo slices after the primary dehydration into emulsified white oil solution, followed by soaking at 60-90 °C for 60-360 min.

In a preferred embodiment, the emulsified white oil solution includes emulsified white oil, penetrant and water.

The emulsified white oil includes following raw materials in mass fraction: 15-30% of saturated fatty acid (preferably hard fatty acid), 15-35% of amino alcohol, 15-45% of amino silicone oil, 5-10% of surfactant and 5-10% of stabilizer.

In a preferred embodiment, the surfactant includes sodium dodecyl sulphate, sodium dodecyl polyoxyethylene ether sulfate, fatty acid and glycerol ester and the like;

in a more preferred embodiment, the surfactant is sodium dodecyl sulphate or sodium dodecyl polyoxyethylene ether sulfate, or sodium dodecyl sulphate, sodium dodecyl polyoxyethylene ether sulfate, fatty acid and glycerol ester mixed in a mass ratio of 3:3:2:2.

The stabilizer includes gelatin, protein acid, hydroxypropyl methylcellulose and the like.

In a more preferred embodiment, the stabilizer is gelatin or hydroxypropyl methylcellulose, or gelatin, protein acid and hydroxypropyl methylcellulose mixed in a mass ratio of 3:3:4.

In a more preferred embodiment, solvents of the emulsified white oil solution include the following raw materials in mass fraction: 35% of saturated fatty acid (hard fatty acid), 25% of amino alcohol, 20% of amino silicone oil, 10% of surfactant (sodium dodecyl sulphate) and 10% of stabilizer (gelatin);

In a more preferred embodiment, the solvents of the emulsified white oil solution include the following raw materials in mass fraction: 35% of saturated fatty acid (hard fatty acid), 25% of amino alcohol, 20% of amino silicone oil, 10% of surfactant (sodium dodecyl polyoxyethylene ether sulfate) and 10% of stabilizer (glyceride).

In a preferred embodiment, in the emulsified white oil solution, a concentration of the emulsified white oil is 20-50 g/L, and a concentration of the penetrant is 2-10 g/L.

In a preferred embodiment, a preparation method of the emulsified white oil solution includes the following steps:

blending the raw materials of the emulsified white oil at room temperature in accordance with the above ratio to obtain the emulsified white oil, then mixing and formulating the emulsified white oil, penetrant, water and a fusion agent (detergent, sodium carbonate solution or soapy water, and the person skilled in the art may determine the amount of the fusion agent to be added according to the actual needs of the situation), and then stirring a resultant mixture for 10-15 min after the preparation, until a stable emulsion is formed, then obtaining the emulsified white oil solution.

In a preferred embodiment, a duration of both the primary dehydration and the secondary dehydration is 15 min.

The embodiments of the present disclosure also provide original ecological bamboo fibers prepared by the preparation method of the original ecological bamboo fibers.

The embodiments of the present disclosure also provide an application of the original ecological bamboo fibers in bamboo fiber yarn.

The embodiments of the present disclosure also provides a method for preparing bamboo fiber yarn, including the following steps:

using a slivering machine to make the original ecological bamboo fibers described above into strips, and then carrying out multiple drawing and carding, and then using a roving machine to spin support yarn, and then using a spinning machine to make the required number of counts, thereby obtaining the bamboo fiber yarn.

In the preferred embodiment, a number of times of drawing and carding is 7 times.

Unless otherwise specified, the raw materials in the examples of the present invention are all obtained by commercial means;

The preparation method of the emulsified white oil solution includes the following steps:

blending the raw materials of the emulsified white oil at room temperature in accordance with the ratio to obtain the emulsified white oil, then mixing and formulating the emulsified white oil, penetrant, water and a fusion agent (detergent, sodium carbonate solution or soapy water, and the person skilled in the art may determine the amount of the fusion agent to be added according to the actual needs of the situation), and then stirring a resultant mixture for 10-15 min after the preparation, until a stable emulsion is formed, then obtaining the emulsified white oil solution.

Embodiment 1

A preparation method of original ecological bamboo fibers, including the following steps.

(1) One-year-old *Bambusa emeiensis* (*Bambusa distegia*) is used with bamboo joints removed, the bamboo tubes are sliced into bamboo sheets with a width of about 2 cm and a thickness of 3-3.5 mm by using the blade of the crashing table, and then the bamboo sheets are naturally dried or oven-dried until the water content is 15-35%.

(2) The dried bamboo sheets obtained in the step (1) are fed into the hopper of an automatic feeder, and the automatic feeder sends the bamboo sheets to the conveying roller table respectively, the bamboo sheet sorting and feeding equipment identifies the front and back sides of the bamboo sheets (the green side and the yellow side of the bamboo sheets) through the sensors, if the green side of the bamboo sheets doesn't conform to the setup, then the bamboo sheet flipping mechanism flips the bamboo sheets over in order to make sure that all the bamboo sheets with the green side of the bamboo sheets are in a uniform direction, and the bamboo sheets are sliced by the blades of the planer machine to produce layers of thin bamboo slices with wrinkles and a thickness of 0.05-0.15 mm, in which the planer machines are provided with 30 planers to perform slicing (3 planer machines are connected in series, and a single machine is set up with 10 planers), the slicing angle of the blade in the bamboo sheets planer machine is 25 degrees to the slicing surface of the bamboo sheets, with a thickness of 0.06 mm (6 threads), and the thickness of the remaining yellow part of the bamboo is 1.2-1.7 mm.

(3) After the slicing is completed, the thin-layer bamboo slice obtained in the step (2) is beaten into cakes every 500 kg, and the thin-layer bamboo slice cakes are assembled by using a feeding cage, and each feeding cage is filled with two thin-layer bamboo slice cakes (1 ton in total). Then, the feeding cage filled with thin-layer bamboo slice cakes is sent to a cooking tank, and a softening solution is added to the cooking tank (the material-liquid ratio is 1:15) for primary cooking, the softening solution includes the following raw materials in mass fraction: sodium hydroxide 6%, sodium silicate 0.5%, JFC penetrant 0.3% and the rest is water. The duration of the primary cooking is 120 min, and the temperature is 95 °C. After the primary cooking, the softening solution is discharged to a reuse device for further use in the next time, and in this embodiment, the softening solution is recycled 10 times. After the softening solution is discharged, clean water is added to clean the thin-layer bamboo slice cakes after primary cooking, and the clean water is discharged to the sewage collection pool. Then a dilute sulfuric acid solution (mass fraction 0.5%) is added to the cooking tank, the pH is adjusted to 3.5, and a mixed solution of sodium chlorite and sodium nitrate is added, in which the concentration of sodium chlorite in the mixed solution is 30 g/L and the concentration of sodium nitrate is 5 g/L, and the mass ratio of the mixed solution to the thin-layer bamboo slice cakes is 1:3.5. The secondary cooking is then carried out by heating, in which the temperature of the secondary cooking is 55 °C and the duration is 60 min. After the end of the secondary cooking, the solution is discharged to the sewage collection tank, and then hydrogen peroxide (concentration 30%), sodium hydroxide and osmotic agent are added to the cooking tank, while water is added to the solution, so that the amount of hydrogen peroxide added to the solution is 60 g/L, the amount of sodium hydroxide added to the solution is 5 g/L, and the amount of JFC osmotic agent added is 5 g/L. The final pH of the solution is kept at 10.5, and the material-liquid ratio is ensured to be 1:10 during the process of the tertiary cooking. The tertiary cooking is then carried out by heating to 90 °C, and the duration of the tertiary cooking is 30 min. After the end of the tertiary cooking, the liquid is discharged to the sewage collection tank, and then the thin-layer bamboo slice cakes are cleaned 2 times with water and the liquid is discharged to the sewage collection tank.

(4) After the end of cooking, the feeding cage is directly lifted to the dehydrator for dehydration of 15 min, and then the feeding cage is lifted into the oiling tank, and the emulsified white oil solution is added for the oiling treatment, where the mass ratio of the thin-layer bamboo slice cakes at the end of cooking to the emulsified white oil solution is 1:20, and the emulsified white oil solution includes emulsified white oil, JFC penetrant and water; the emulsified white oil is obtained by mixing the following raw materials in mass fraction: 25% of saturated fatty acid (hard fatty acid), 25% of amino alcohol, 30% of amino silicone oil, 10% of surfactant (sodium dodecyl sulphate) and 10% of stabilizer (gelatin); in the emulsified white oil solution, the concentration of emulsified white oil is 50 g/L, the concentration of JFC penetrant is 5 g/L, the temperature for oiling is 60 °C and the duration is 6 h; after oiling and draining, the feeding cage is again lifted into the dehydrator for dehydration for 15 min.

(5) After dehydration, the obtained fibers are shaken by the equipment mechanism, and then evenly laid on the drying belt by the feeding mechanism for drying. The dryer is assembled with modularized unit structure, and the air volume and steam volume are adjusted in time according to the temperature change of each module, so that the dryer output and moisture content reach the production needs. After drying, the fibers are packed and sent to the health room to be nourished for 5-10 days, i.e. to obtain the original ecological bamboo fibers. After nourishing, the original bamboo fibers are carded by carding machine (A1181F) of Qingdao jinchaoyuc Machinery Co., Ltd. and the length of bamboo fibers is tested by sampling: 9.8-13.3 cm, fineness: 7.27-8.02 dtex, and the breaking strength: 3.47-3.87 cN/dtex.

Embodiment 2

The original ecological bamboo fibers obtained from Embodiment 1 are made into bamboo fiber yarn, including the following steps:

1. Preparation of raw materials: the original ecological bamboo fibers obtained in Embodiment 1 are bundled fibers with an average length of 10-15 cm, and opening and carding is needed to improve spinnability. In this embodiment, 10 kg of original ecological bamboo fibers are prepared, and 7 kg of bamboo fiber with average length of 30-50 mm and fineness of 40-80 μm is obtained after carding and impurity removal. For the weakness of poor spinnability of bamboo fibers, a certain proportion (45-90%) of long-staple cotton or polyester fibers are mixed in the selection of raw materials (in this embodiment, long-staple cotton is mixed at 90%). Meanwhile, the bamboo fibers are humidified and smothered for 3-7 days in order to overcome the weaknesses of the bamboo fibers, which are poor in length and uneven in fiber fineness, and are prone to breakage.

2. Process Flow (1) Cotton fiber (polyester fiber may also be used) and bamboo fibers are mixed to make sliver, and the specific process is as follows: A002D cotton picker-A006 cotton mixer-A036 cotton opener-A092A double-box cotton feeder-A076C winding machine-A186D carding machine.

1) Opening and picking: to minimize damage to fibers, free striking is used as much as possible and grip striking is avoided. A lower striking speed is selected to avoid excessive striking of fibers and to allow impurities to be removed before they are struck. The roller speed of the cotton roll is 10 revolutions per minute (r/min); the striking speed of the A076C winding machine is 600-750 r/min.

2) Carding process: the impurities and short staple in bamboo fibers are removed. Accordingly, the carding process is mainly to exclude impurities, short staple and carding fibers. Under the premise of ensuring the carding of fibers, the speed difference of the taker-in is reduced, and the speed of the taker-in is 650 r/min, the cylinder speed is 260 r/min, the doffer speed 18 r/min, the cover plate speed is 95 mm/min, the cylinder-cover plate spacing is 0.26 mm, the spacing between taker-in and feeder plate is 0.33 mm, and the taker-in roller-cylinder spacing is 0.20 mm.

(2) Spinning: the specific process is: A272D drawing machine-A272F drawing machine-A456D roving machine-FA502A spinning machine-1332MD winding machine-FA706 doubling winder-VTS-09 double twister-baling.

In the drawing process of spinning, in order to improve the yarn quality, the principle of heavy pressure, large gauge and low speed is adopted, and the high elastic cots are selected to effectively control the fibers and improve the evenness. In the roving process, it is necessary to appropriately increase the roving twist coefficient (twist coefficient 85) to reduce accidental drafting and overcome the problem of poor cohesion of bamboo fibers. Spinning process parameters: spinning twist coefficient 440.

The bamboo fiber yarn is obtained after carding, drawing and spinning the original ecological bamboo fibers into sliver yarn by the above process. In this embodiment, carded bamboo fibers (7 kg, accounting for 10%) and cotton fibers (63 kg, accounting for 90%) are used to make 18-inch yarn and 58.80 kg yarn of of bamboo 10/cotton90.

Finally, the yarn yield of this embodiment is 84%, and the technical parameters of the finished yarn are as follows: the average dry weight is 2.94, the index deviation is 0.06, the straight tensile strength is 445, the lowest single end strength is 318, the moisture regain is 6.8, the actual numbering is 32.8, the single end strength coefficient of variability CV % is 7.6, the uneven weight of 100 meters is 1.59, and the breaking strength is 13.6, the uster CV % is 18.22, the kilometre detail is 1.0, the kilometre thick knots are 1268, the kilometre cotton knots are 1567, the spinning twist is 77.6, and the twist coefficient is 444.

Embodiment 3

A preparation method of the original ecological bamboo fibers includes the following steps:

(1) two-year-old fresh Bambusa chungii are taken and the bamboo joints are removed, the bamboo tubes are sliced into bamboo sheets with a width of about 2 cm, a thickness of 4-5 mm and a length of 60-100 cm by using the blade of the crashing table, and the bamboo sheets are naturally dried for 3-10 days.

(2) The dried bamboo sheets obtained in the step (1) are fed into the hopper of the automatic feeder, and the automatic feeder sends the bamboo sheets to the conveying roller table respectively, the bamboo sheet sorting and feeding equipment identifies the front and back sides of the bamboo sheets (the green side and the yellow side of the bamboo sheets) through the sensors, if the green side of the bamboo sheets doesn't conform to the setup, then the bamboo sheet flipping mechanism flips the bamboo sheets over in order to make sure that all the bamboo sheets with the green side of the bamboo sheets are in a uniform direction, and the bamboo sheets are sliced by the blades of the planer machine to produce layers of thin bamboo slices with wrinkles, in which the planer machines are provided with 50 planers to perform slicing (5 planer machines are connected in series, and a single machine is set up with 10 planers), the slicing angle of the blade in the bamboo sheets planer machine is 20 degrees to the slicing surface of the bamboo sheets, with a thickness of 0.06 mm (6 threads), and the thickness of the remaining yellow part of the bamboo is 1.0-2.0 mm.

(3) After the slicing is completed, the thin-layer bamboo slice obtained in the step (2) is beaten into cakes every 500 kg, and the thin-layer bamboo slice cakes are assembled by using a feeding cage, and each feeding cage is filled with two thin-layer bamboo slice cakes (1 ton in total). Then, the feeding cage filled with thin-layer bamboo slice cakes is sent to a cooking tank, and a softening solution is added to the cooking tank (the material-liquid ratio is 1:15) for primary cooking, the softening solution includes the following raw materials in mass fraction: sodium hydroxide 5.5%, sodium silicate 0.5%, JFC penetrant 0.5% and the rest is water. The duration of the primary cooking is 150 min, and the temperature is 90 °C. After the primary cooking, the softening solution is discharged to a reuse device for further use in the next time, and in this embodiment, the softening solution is recycled 8 times. After the softening solution is discharged, clean water is added to clean the thin-layer bamboo slice cakes after primary cooking, and the clean water is discharged to the sewage collection pool. Then a dilute sulfuric acid solution (mass fraction 0.3%) is added to the cooking tank, the pH is adjusted to 3.5, and a mixed solution of sodium chlorite and sodium nitrate is added, in which the concentration of sodium chlorite in the mixed solution is 80 g/L and the concentration of sodium nitrate is 15 g/L, and the mass ratio of the mixed solution to the thin-layer bamboo slice cakes is 5:1. The secondary cooking is then carried out by heating, in which the temperature of the secondary cooking is 60 °C and the duration is 45 min. After the end of the secondary cooking, the solution is discharged to the sewage collection tank, and then hydrogen peroxide (concentration 30%), sodium hydroxide and penetrant are added to the cooking tank, while water is added to the solution, so that the amount of hydrogen peroxide added to the solution is 90 g/L, the amount of sodium hydroxide added to the solution is 6 g/L, and the amount of JFC penetrant added is 5 g/L. The final pH of the solution is kept at 11, and the material-liquid ratio is ensured to be 1:10 during the process of the tertiary cooking. The tertiary cooking is then carried out by heating to 90 °C, and the duration of the tertiary cooking is 30 min. After the end of the tertiary cooking, the liquid is discharged to the sewage collection tank, and then the thin-layer bamboo slice cakes are cleaned 2 times with water and the liquid is discharged to the sewage collection tank.

(4) After the end of cooking, the feeding cage is directly lifted to the dehydrator for dehydration of 15 min, and then the feeding cage is lifted into the oiling tank, and the emulsified white oil solution is added for the oiling treatment, where the mass ratio of the thin-layer bamboo slice cakes at the end of cooking to the emulsified white oil solution is 1:20, and the emulsified white oil solution includes emulsified white oil, JFC penetrant and water; the emulsified white oil is obtained by mixing the following raw materials in mass fraction: 25% of saturated fatty acid (hard fatty acid), 30% of amino alcohol, 30% of amino silicone oil, 10% of surfactant (sodium dodecyl polyoxyethylene ether sulfate) and 5% of stabilizer (hydroxypropyl methylcellulose); in the emulsified white oil solution, the concentration of emulsified white oil is 80 g/L, the concentration of JFC penetrant is 5 g/L, the temperature for oiling is 60 °C and the duration is 3 h; after oiling and draining, the feeding cage is again lifted into the dehydrator for dehydration for 15 min.

(5) After dehydration, the obtained fibers are shaken by the equipment mechanism, and then evenly laid on the drying belt by the feeding mechanism for drying. The dryer is assembled with modularized unit structure, and the air volume and steam volume are adjusted in time according to the temperature change of each module, so that the dryer output and moisture content reach the production needs. After drying, the fibers are packed and sent to the health room to be nourished for 5-10 days, to obtain the original ecological bamboo fibers.

Embodiment 4

The original ecological bamboo fibers obtained from Embodiment 3 are made into bamboo fiber yarn, including the following steps:

after the pre-carding process, the above original ecological bamboo fibers are made into bamboo fiber strips through joint carding, needle carding, and fine carding and then mixed with flax fiber strips (50:50) to be combined, followed by several times of drawing and carding, then the roving machine is utilized to prepare coarse yarns, which is then spun by semi-wet spinning to obtain fine yarn. In this embodiment, ecological long bamboo fibers (length 35-65 cm) are used to prepare 50 kilograms of bamboo fiber slivers through combined carding, needle carding and fine carding, followed by drawing with 50 kilograms of flax sliver to form yarn, and 85 kilograms of yarn of bamboo (50)/flax (50) with metric number of 6.5 is obtained by using semi-wet spinning machine. Other process steps and parameters are the same as those in Embodiment 2.

Comparative Embodiment 1

A preparation method of bamboo fibers, including the following steps.

(1) Three-year-old fresh *Bambusa textilis* is used with bamboo joints removed, the bamboo tubes are divided into bamboo sheets with a width of about 1.5 cm and a thickness of 3-3.5 mm by using the blade of the crashing table, followed by naturally drying for a week.

(2) The dried bamboo sheets obtained in the step (1) are fed into the hopper of an automatic feeder, and the automatic feeder sends the bamboo sheets to the conveying roller table respectively, the bamboo sheet sorting and feeding equipment identifies the front and back sides of the bamboo sheets (the green side and the yellow side of the bamboo sheets) through the sensors, if the green side of the bamboo sheets doesn't conform to the setup, then the bamboo sheet flipping mechanism flips the bamboo sheets over in order to make sure that all the bamboo sheets with the green side of the bamboo sheets are in a uniform direction, and the bamboo sheets are sliced by the blades of the planer machine to produce layers of thin bamboo slices with wrinkles, in which the planer machines are provided with 30 planers to perform slicing (3 planer machines are connected in series, and a single machine is set up with 10 planers), the slicing angle of the blade in the bamboo sheets planer machine is 35 degrees to the slicing surface of the bamboo sheets, with a thickness of 0.08 mm (8 threads), and the thickness of the remaining yellow part of the bamboo is 0.6-1.1 mm.

(3) After the slicing is completed, the thin-layer bamboo slice obtained in the step (2) is beaten into cakes every 500 kg, and the thin-layer bamboo slice cakes are assembled by using a feeding cage, and each feeding cage is filled with two thin-layer bamboo slice cakes (1 ton in total). Then, the feeding cage filled with thin-layer bamboo slice cakes is sent to a cooking tank, and a softening solution is added to the cooking tank (the material-liquid ratio is 1:15) for primary cooking, the softening solution includes the following raw materials in mass fraction: sodium hydroxide 8%, sodium silicate 1.2%, JFC penetrant 0.5% and the rest is water. The duration of the primary cooking is 150 min, and the temperature is 90 °C. After the primary cooking, the softening solution is discharged to a reuse device for further use in the next time, and in this embodiment, the softening solution is recycled 8 times. After the softening solution is discharged, clean water is added to clean the thin-layer bamboo slice cakes twice, and the liquid is discharged to the sewage collection pool.

(4) After the end of cooking, the feeding cage is directly lifted to the dehydrator for dehydration of 15 min, and then the feeding cage is lifted into the oiling tank, and the emulsified white oil solution is added for the oiling treatment, where the mass ratio of the thin-layer bamboo slice cakes at the end of cooking to the emulsified white oil solution is 1:20, and the emulsified white oil solution includes emulsified white oil, JFC penetrant and water; the emulsified white oil is obtained by mixing the following raw materials in mass fraction: 35% of saturated fatty acid (hard fatty acid), 25% of amino alcohol, 20% of amino silicone oil, 10% of surfactant and 10% of stabilizer; the surfactant includes the following raw materials in parts by weight: 3 parts of sodium dodecyl sulphate, 3 parts of sodium dodecyl polyoxyethylene ether sulfate, 2 parts of fatty acid and 2 parts of glyceride. The stabilizer includes the following raw materials in parts by weight: 3 parts of gelatin, 3 parts of protein acid and 4 parts of hydroxypropyl methylcellulose. In the emulsified white oil solution, the concentration of emulsified white oil is 120 g/L, the concentration of JFC penetrant is 5 g/L, and the temperature for oiling is 60 °C and the duration is 3 h; after oiling and draining, the feeding cage is again lifted into the dehydrator for dehydration for 15 min.

(5) After dehydration, the obtained fibers are shaken by the equipment mechanism, and then evenly laid on the drying belt by the feeding mechanism for drying. The dryer is assembled with modularized unit structure, and the air volume and steam volume are adjusted in time according to the temperature change of each module, so that the dryer output and moisture content reach the production needs. After drying, the fibers are packed and sent to the health room to be nourished for 5-10 days, to obtain the original ecological bamboo fibers.

Comparative Embodiment 2

The original ecological bamboo fibers obtained in Comparative embodiment 1 are prepared into bamboo fiber yarn according to the following steps.

The technological process is as follows: bamboo fiber-soft flax-stacking fermentation-carding-drawing-spinning-winding.

The method enables preparation of pure bamboo fiber yarn, including processes of raw material preparation, flax softening, oiling and moistening, stacking and fermenting, carding, drawing and spinning, so as to improve the softness and spinnability of bamboo fiber. After the first and last passes of the carding by the carding machine with the effects of homogenising and blending, the impurities and short fibers are removed, and the process fibers of certain lengths and finenesses are obtained by carding, and are wound into rolls after being made into bamboo fiber strips. Then the uniformity and fineness of the fiber strips are improved by the drawing and carding action of the drawing machine (needle carding machine), and then spun by the spinning machine into fine yarns of certain specifications. There are two systems: warp and weft. The warp yarn system passes through three drawing machines to spin fine yarns (3.5-1.5 metric number); the weft yarn system passes through two drawing machines to spin fine yarns (0.5-1.2 metric number).

Comparative Embodiment 3

A method of preparing bamboo fiber, with the difference from Embodiment 1 in that a biennial *Bambusa emeiensis* (*Bambusa distegia*) is used, and the slicing angle of the blade of the planer machine to the slicing surface of the bamboo slice in step (2) is 30°, and the rest of the process steps and parameters are the same as in those of Embodiment 1, and the bamboo fibers are finally obtained.

Comparative Embodiment 4

The original ecological bamboo fibers obtained in Comparative embodiment 3 are prepared into bamboo fiber yarn according to the following steps.

(1) Raw material preparation: the original bamboo fiber for nourishing is bundle fibers. In this embodiment, 5 kg of raw material fiber is prepared, and 4 kg of bamboo fiber with average length of 30-50 mm and fineness of 50-85 μm is obtained after carding and impurity removal.

(2) Process Flow

Cotton fiber (50%) and bamboo fiber (50%) are mixed to make strips, and the steps are as follows:

A002D cotton picker-A006 cotton mixer-A036 cotton opener-A092A double-box cotton feeder-A076C winding machine-A186D carding machine.

Drawing and spinning, and the steps are as follows:

A272D drawing machine-A272F drawing machine-A456D roving machine-FA502A spinning machine-1332MD winding machine-FA706 doubling winder-VTS-09 double twister-baling.

In this embodiment, carded bamboo fibers (4 kg, accounting for 50%) and cotton fibers (4 kg, accounting for 50%) are used to make 6 kg yarn of 9.5 metric number.

Technical Effect

1. The length, fineness and strength of original bamboo fibers obtained in Embodiments 1 and 3 and Comparative embodiments 1 and 3 are tested.

The test results are as follows:

Embodiment 1: *Bambusa emeiensis* fibers (1 year old): length: 9.8 cm, fineness: 8.02 dtex, breaking strength: 3.87 cN/dtex;

Comparative embodiment 3: *Bambusa emeiensis* fibers (2 years old): length: 6.5 cm, fineness: 7.27 dtex, breaking strength: 3.47 cN/dtex;

Embodiment 3:*Bambusa chungii* fibers (2 years old): length: 13.3 cm, fineness: 5.82 dtex, breaking strength: 3.23 cN/dtex.

Comparative embodiment 1: *Bambusa chungii* fibers (3 years old): length: 12.5 cm, fineness: 4.95 dtex, breaking strength: 3.18 c N/dtex.

2. The bamboo fiber content, counts and color of the bamboo fiber yarns obtained in Embodiments 2 and 4 and Comparative embodiments 2 and 4 are tested.

The test results are as follows.

Bamboo fiber content of Embodiment 2: bamboo10/cotton90; counts: 18 English counts; color: white.

Bamboo fiber content of Embodiment 4: bamboo50/flax50; counts: 6.5 metric number; color: white.

Bamboo fiber content of Comparative embodiment 2: bamboo 100%; counts: 1.2 metric number; color: yellow.

Bamboo fiber content of Comparative embodiment 4: bamboo50/cotton50; counts: 9.5 metric number; color: white.

The above describes only the preferred embodiments of this application, but the protection scope of this application is not limited to this. Any change or replacement that may be easily thought of by a person familiar with this technical field within the technical scope disclosed in this application should be included in the protection scope of this application. Therefore, the protection scope of this application should be based on the protection scope of the claims.

What is claimed is:

1. A method for preparing original ecological bamboo fibers, comprising the following steps:

cutting a bamboo material into sheets; feeding the bamboo sheets into a bamboo-sheet planer machine and slicing the bamboo sheets to obtain bamboo slices having sequential wrinkles and a thickness of 0.05-0.25 millimeters, wherein a number of slicing passes is 20-60, and the bamboo-sheet planer machine has a blade slicing angle of 15-80 degrees to a slicing surface of the bamboo slices; cake pressing the bamboo slices; carrying out a cooking treatment on the cake-pressed bamboo slices; cleaning and post-processing the bamboo slices after cooking treatment to obtain the original ecological bamboo fibers, wherein the cooking treatment comprises the following steps:

carrying out primary cooking on the cake-pressed bamboo slices with a softening solution under alkaline conditions, and cleaning after the primary cooking;

carrying out secondary cooking using a mixture of sodium chlorite and sodium nitrate under acidic conditions, and cleaning after the secondary cooking; and carrying out tertiary cooking under alkaline conditions using a mixture of hydrogen peroxide and a penetrant.

2. The method for preparing the original ecological bamboo fibers according to claim 1, wherein a temperature of the primary cooking is 90-150 degrees Celsius, and a duration is 60-240 minutes;

the softening solution is a mixed aqueous solution of sodium hydroxide, penetrant and sodium silicate;

a mass concentration of the sodium hydroxide is 5-12%; and a mass concentration of the sodium silicate is 0.5-2%.

3. The method for preparing the original ecological bamboo fibers according to claim 1, wherein a temperature of the secondary cooking is 45-65 degrees Celsius, and a duration is 35-120 minutes; and a pH value of a mixed solution of sodium chlorite and sodium nitrate is 3-5, with a concentration of 20-100 grams per liter of sodium chlorite and 5-20 grams per liter of sodium nitrate.

4. The method for preparing the original ecological bamboo fibers according to claim 1, wherein a temperature of the tertiary cooking is 65-90 degrees Celsius, and a duration is 30-60 minutes;

a pH value of the mixed solution of the hydrogen peroxide and the penetrant is 9-11, with a concentration of the hydrogen peroxide of 15-150 grams per liter and a concentration of the penetrant of 2-10 grams per liter; and the mixed solution of the hydrogen peroxide and the penetrant also comprises the sodium hydroxide, and a concentration of the sodium hydroxide is 3-15 grams per liter.

5. The method for preparing the original ecological bamboo fibers according to claim 1, wherein the post-processing comprises primary dehydration, oiling, secondary dehydration, drying, and opening and carding.

6. The method for preparing the original ecological bamboo fibers according to claim 5, wherein the oiling is to put the bamboo slices after the primary dehydration into an emulsified white oil solution, followed by soaking at 60-90 degrees Celsius for 60-360 minutes.

* * * * *